United States Patent [19]

Martin, Sr.

[11] 4,063,442

[45] Dec. 20, 1977

[54] METHOD AND APPARATUS FOR FORMING TUBES

[76] Inventor: Robert P. Martin, Sr., 7809 W. 130th St., Parma, Ohio 44130

[21] Appl. No.: 745,558

[22] Filed: Nov. 29, 1976

[51] Int. Cl.[2] ..... B21D 5/12

[52] U.S. Cl. ..... 72/166; 72/169; 72/173

[58] Field of Search ..... 72/166, 169–175, 72/DIG. 14

[56] References Cited

U.S. PATENT DOCUMENTS

| | | | |
|---|---|---|---|
| 186,124 | 1/1877 | Goodell | 72/166 |
| 608,706 | 8/1898 | Osborne | 72/166 |
| 1,590,491 | 6/1926 | Beall | 72/169 |

OTHER PUBLICATIONS

"Simple Rolling System Forms Curved Shapes," pp. 50, 51, Iron Age., Nov. 15, 1976.

*Primary Examiner*—Milton S. Mehr

*Attorney, Agent, or Firm*—McNenny, Perne, Gordon, Gail, Dickinson & Schiller

[57] ABSTRACT

A machine and method for shaping a workpiece into a cylindrical tube includes a mandrel, a forming roll, a guide roll, and a continuous forming belt extending partially around the mandrel and partially around the forming roll and guide roll. The workpiece is inserted between the belt and the mandrel at an entry opening. An actuator device causes the mandrel to simultaneously tighten the belt and squeeze the workpiece between the mandrel and the forming roll during the forming operation.

14 Claims, 4 Drawing Figures

Fig. 1
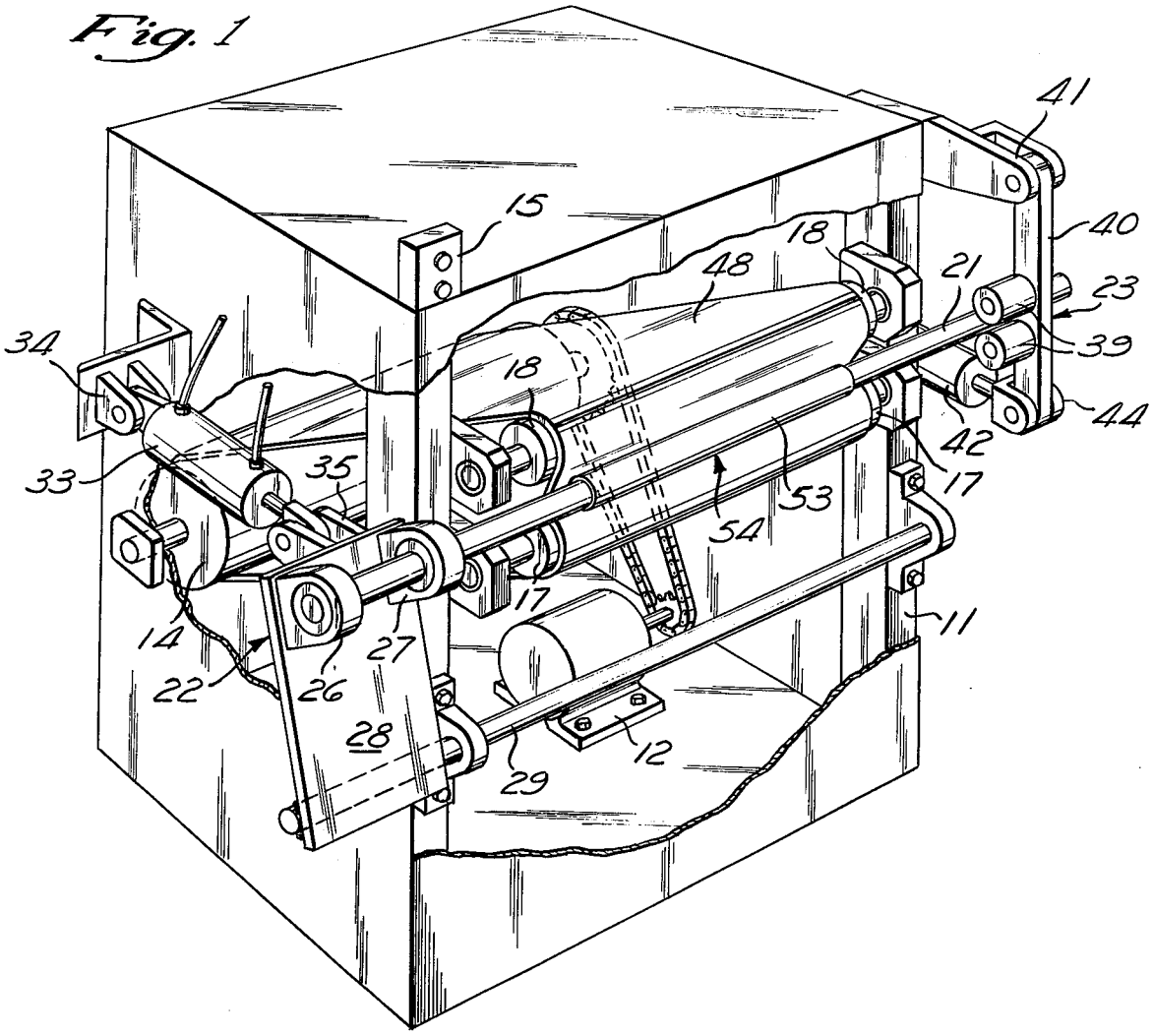
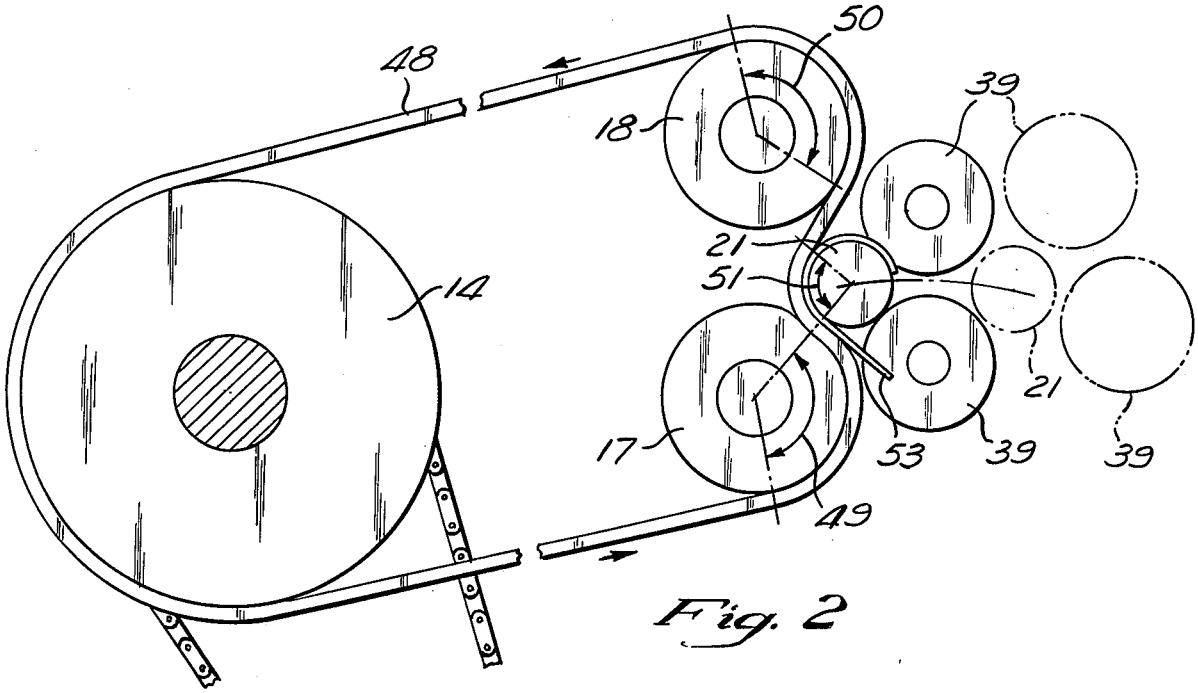
Fig. 2

METHOD AND APPARATUS FOR FORMING TUBES

BACKGROUND OF THE INVENTION

The present invention relates generally to tube forming machines and methods and, more particularly, to a tube forming machine and method in which a flat workpiece is shaped into a cylindrical tube.

Prior art tube forming machines and methods are known which utilize a continuous belt which wraps partially around a cylindrical mandrel. As the mandrel rotates, a workpiece is fed between the belt and the mandrel to shape the workpiece. Machines and methods of this type are shown in U.S. Pat. Nos. 608,706, 2,990,001, and 3,357,222.

Tube forming machines and methods are also known which include a cylindrical mandrel and two back-up rolls which wrap a flat workpiece around the mandrel. After the flat workpiece is deformed, one end of the mandrel is released to permit removal of the workpiece. Machines and methods of this type are disclosed in U.S. Pat. Nos. 1,590,491, 1,973,164, and 2,432,666.

SUMMARY OF THE INVENTION

The present invention departs from prior art tube forming machines and methods by providing a rotating cylindrical mandrel and a continuous forming belt extending through a predetermined circumferential extent around the mandrel. At an entry location where the workpiece first enters the machine between the belt and the mandrel, the mandrel sqeezes the workpiece against a forming roll to provide a high pressure zone for shaping the workpiece to the surface of the mandrel.

To provide a high pressure zone at the entry location, an actuator device urges the mandrel with a predetermined force in a direction to simultaneously tighten the belt and squeeze the workpiece between the mandrel and the forming roll. The entry location is located along a straight line extending between the center of the mandrel and the center of the forming roll, and the belt follows an S-shaped path first around the forming roll and then around the mandrel.

The actuator device includes a bearing assembly on each end of the mandrel. Pneumatic actuators are associated with each of the bearing assemblies so that each bearing assembly is movable along a predetermined path independently of the other bearing assembly. The bearing assembly on one end of the mandrel provides a cantilever support for the mandrel and moves the mandrel between its operating position and an unloading position. The second bearing assembly is movable between an operating position and an unloading position spaced from the mandrel to permit the finished tube to slide off of the free end of the mandrel.

BRIEF DESCRIPTION OF THE DRAWINGS

These and other aspects and advantages of the invention are incorporated in the preferred embodiment shown in the accompanying drawings, wherein:

FIG. 1 is a perspective view of the tube forming machine and method according to the present invention;

FIG. 2 is an enlarged schematic showing of a portion of the machine shown in FIG. 1 with the mandrel in its operating position, and with the mandrel shown in an unloading position in phantom;

DETAILED DESCRIPTION OF THE DRAWINGS

Figure 3:
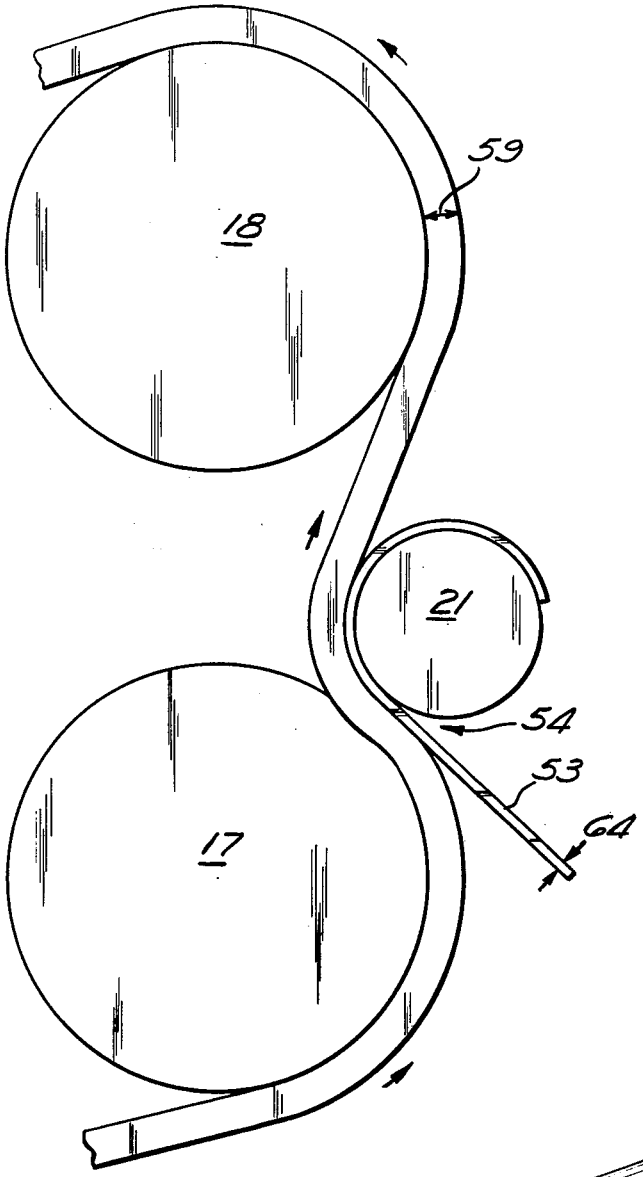
FIG. 3 is an enlarged view of a portion of the machine shown in FIG. 2.

Referring now to the drawings in greater detail, a tube forming machine includes a frame 11 which may be constructed of welded 90° angle iron or of other suitable material. An electric motor 12 is secured to the frame 11 and drives a drive roll 14 by a suitable chain and sprocket arrangement. The drive roll 14 is a steel roll which is rotatably journaled on the frame 11 by suitable bearing blocks, only one of which is shown in FIG. 1. The drive roll and bearing blocks are slidably mounted on the frame 11 and are provided with a suitable device such as take-up screws (not shown) for moving the drive roll 14 back and forth. In the preferred embodiment, the outside diameter of the steel drive roll 14 is 6 inches. An electrical switch 15 is electrically connected to the motor 12 for actuating and deactuating the motor 12 and drive roll 14.

An entry forming roll 17 and an exit guide roll 18 are also journaled on the frame 11 by suitable bearings located at each of their ends. The outer surface of each of the rolls 17 and 18 is resilient and is neoprene with a 50 Durometer hardness in the preferred embodiment. The bearings associated with each of the rolls 17 and 18 are slidably adjustable independently of one another on the frame 11. In the preferred embodiment, the outside diameter of each of the rolls 17 and 18 is 2 inches.

The machine shown in the drawings also includes a steel cylindrical mandrel 21. The mandrel 21 has a longitudinal axis which is parallel to the longitudinal axes of each of the rolls 17 and 18, and the mandrel 21 extends longitudinally beyond the rolls 17 and 18 in both directions. A first bearing arrangement 22 supports one end of the mandrel 21, and a second bearing arrangement 23 is provided on the other end of the mandrel 21. The outside diameter of the mandrel 21 is significantly smaller than the outside diameter of the roll 17 so that the roll 17 creates a zone of high pressure against the mandrel along a substantial circumferential extent of the mandrel. The roll 17 is at least one and one-half times the diameter of the mandrel 21, which is seven-eighths inch in the preferred embodiment.

The first bearing arrangement 22 includes two pillow blocks 26 and 27 each secured to a mounting plate 28 for providing a cantilever mounting of the mandrel 21 on the frame 11. Suitable snap rings or the like may be used on the mandrel 21 to prevent the mandrel 21 from moving longitudinally out of the pillow blocks 26 and 27. The mounting plate 28 is a flat steel plate which is welded to a pivot bar 29. The pivot bar 29 is journaled on the frame 11 so that the mounting plate 28 and mandrel 21 can pivot laterally toward and away from the forming roll 17 in a manner described below. The first bearing arrangement 22 also includes a double acting pneumatic cylinder 33 having its cylinder end secured to the frame 11 by a clevis 34 and having its rod end secured to the mounting plate 28 by another clevis 35. By this arrangement, extension of the pneumatic cylinder 33 moves the mandrel 21 away from the forming roll 17 to an unloading position shown in phantom in FIG. 2, while retraction of the pneumatic cylinder 33 moves the mandrel 21 to an operating position shown in FIGS. 1–3.

The second bearing arrangement 23 includes two bearings or rollers 39 which are journaled on a mounting plate 40. The mounting plate 40 is pivotally secured to the frame 11 by a clevis 41. The second bearing arrangement 23 also includes a double acting pneumatic cylinder 42. The cylinder 42 has its cylinder end pivotally secured to the frame 11 by a clevis (not shown) which is identical to the clevis 34 and has its rod end pivotally secured to the mounting plate 40 by another clevis 44. When the second bearing arrangement 23 is in its operating position shown in FIGS. 1–3, the rollers 39 engage the end of the mandrel 21 to continuously force the mandrel 21 in a direction toward the forming roll 17 as described below. When the second bearing arrangement 23 is in its unloading position, the cylinder 42 is extended to move the rollers 39 away from the forming roll 17 and away from the mandrel 21 as shown in phantom in FIG. 2 to permit unloading the formed tube (FIGS. 1 and 4) by sliding the formed tube off the free end of the mandrel 21.

A continuous resilient elastomeric forming belt 48 is powered by the drive roll 14. In the preferred embodiment, the belt 48 is a commercially available four ply fabric impregnated with neoprene and is 9/64 inches thick. The forming belt 48 extends around and engages each of the rolls 17 and 18 through a predetermined angular extent 49 and 50, respectively. The forming belt 48 extends around the mandrel 21 through a predetermined angular extent 51, which is between 90 and 120 degrees and which is 110 degrees in the preferred embodiment. The belt 48 is driven at approximately 6 feet per minute in the preferred embodiment.

As shown in the drawings, the belt 48 travels along an S-shaped path first around the forming roll 17 and then around the mandrel 21 and finally to the guide roll 18. When viewed from the mandrel 21, the belt 48 follows a convex path around the forming roll 17 and then follows a concave path around the mandrel 21 and a second convex path around the guide roll 18. As discussed further below, the forming roll 17 creates a zone of high pressure at the entry opening 54 to assist in causing the workpiece to conform to the shape of the mandrel while the guide roll 18 causes the belt 48 to wrap around the mandrel 21 through the angle 51.

The outer surface of the entry forming roll 17 and the outer surface of the mandrel 21 cooperatively define a longitudinally extending entry opening 54 therebetween through which the forming belt 48 passes and into which a workpiece 53 is fed as explained below. The width of the entry opening 54 is no greater than the sum of the thickness of the belt 48 plus the thickness of the workpiece 53. The pneumatic cylinders 33 and 42 maintain a constant predetermined force urging the mandrel 21 in a direction to simultaneously tighten the belt 48 and squeeze the workpiece 53 between the mandrel 21 and the forming roll 17. This arrangement produces a zone of high pressure at the entry opening 54 along a line drawn between the center of the forming roll 17 and the center of the mandrel 21. In this zone of high pressure, the constant force with which the pneumatic cylinders 33 and 42 push the mandrel 21 in a direction toward the forming roll 17 exerts a force on the workpiece at the entry opening to cause the workpiece 53 to conform to the shape of the outer surface of the mandrel 21 immediately as the workpiece enters the machine between the mandrel 21 and the belt 48. This force on the mandrel 21 also tightens the belt 48 between the rolls 17 and 18 to hold the workpiece against the mandrel after it passes through the entry opening 54.

To form a cylindrical tube, the electric motor 12 is first actuated by the switch 15 to commence turning the drive roll 14 and the forming belt 48 and the rolls 17 and 18. The pneumatic cylinders 33 and 42 are supplied with air by operation of a foot pedal control (not shown) to retract their piston rods. This causes the pillow blocks 26 and 27 and the roll 39 to move to an operating position as shown in FIGS. 1, 2 and 3 in which they simultaneously tighten the belt 48 and squeeze the belt 48 between the mandrel 21 and the forming roll 17.

A flat rectangular sheet metal workpiece such as the workpiece 53 (FIGS. 2 and 3) is then selected for being shaped into a tube. The workpiece 53 is inserted between the mandrel 21 and the belt 48 at the location of the forming roll 17. In the high pressure zone provided at the entry opening 54, the mandrel 21 squeezes the workpiece 53 against the forming belt 48 and forming roll 17 to immediately shape the entering portion of the workpiece 53 to the curvature of the mandrel 21. Because this action commences at the leading edge of the workpiece 53 as soon as the workpiece enters the opening 54 and because the tightened belt 48 holds the workpiece securely against the mandrel 21 after the workpiece passes through the entry opening 54, the entire workpiece 53 is deformed uniformly and without flat spots.

After the formed workpiece 53 has been turned through one complete revolution so that the trailing edge of the workpiece has moved out from between the mandrel 21 and belt 48, the workpiece may be removed from the machine. To remove the workpiece from the machine, air is supplied to the pneumatic cylinders 33 and 42 to extend the piston rods. This rotates the mounting plate 28 and the mounting plate 40 about their pivotal axes to move the mandrel 21 with the workpiece wrapped around it away from the forming roll 17 and away from the forming belt 48. This moves the rollers 39 a greater distance than the bearings 26 and 27 are moved so that the rollers 39 also move away from the free end of the cantilever mandrel 21 so that the workpiece can slide off the end of the mandrel 21. The motor 12 and drive 14 and belt 48 are not stopped during this unloading of the workpiece, but the mandrel 21 stops rotating because it is separated from the belt 48. By this arrangement, the tension on the belt 48 is released during unloading, and the mandrel 21 may be quickly moved back to its operating position by the cylinders 33 and 42 for receiving another workpiece.

Figure 4:
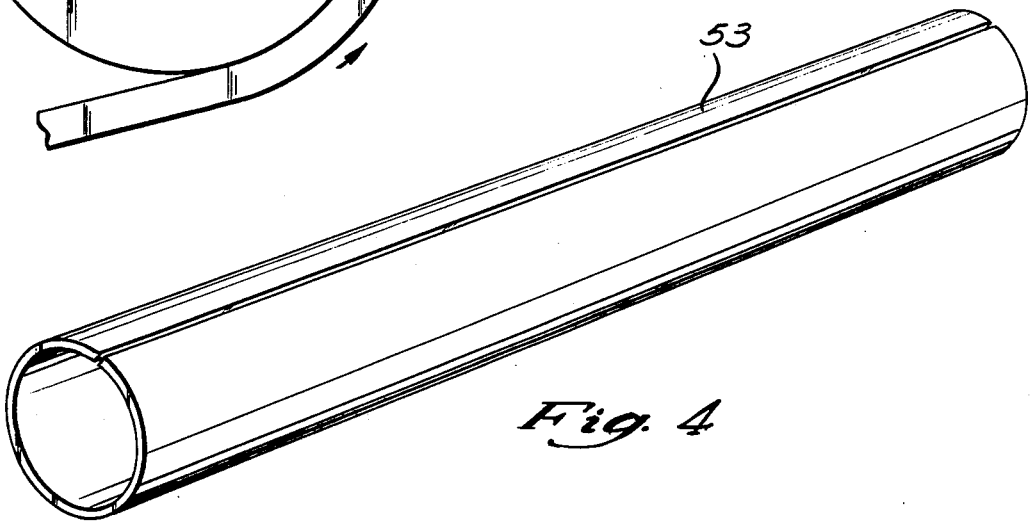
FIG. 4 is a perspective view of a tube formed by the machine and method shown in FIGS. 1–3.

Due to the spring back of the metal of the workpiece 53, the diameter of the tube formed on the machine is not exactly equal to the outside diameter of the mandrel 21. In the preferred embodiment illustrated in the drawings, the outside diameter of the mandrel 21 is seven-eighths inch and the diameter of the tube formed from a 0.014 inch thick steel sheet metal workpiece is 1 inch. If the workpiece is selected so that its length from its leading edge to its trailing edge is exactly equal to the circumference of the mandrel 21 as shown in the drawings, the tube removed from the machine will be open a slight distance along its longitudinal seam due to the spring back of the material. This construction, which is illustrated in FIG. 4, may be left with an open seam, or the seam may be closed by welding or by mechanical means if the use of the tube so requires. Alternatively, the length of the workpiece from its leading edge to its trailing edge may be slightly greater than the circumference of the mandrel 21. In this instance, the trailing edge of the workpice slightly overlaps the leading edge of the workpice as the tube is formed, and the spring back of the material then permits the trailing edge to engage the leading edge to form a tube without a gap along its longitudinal seam.

What is claimed is:

1. A tube forming machine for shaping a sheet metal blank having a predetermined thickness into a cylindrical tube comprising a frame, an elongated mandrel having a cylindrical outer surface, first bearing means supporting said mandrel, a forming roll having a cylindrical outer surface adjacent said cylindrical outer surface of said mandrel, second bearing means supporting said forming roll, a continuous forming belt extending along a path first around a predetermined circumferential extent of said forming roll and then between said cylindrical outer surfaces of said forming roll and said mandrel and then around a predetermined circumferential extent of said mandrel, said forming belt having an interior surface and an exterior surface, said first and second bearing means holding said forming roll and said mandrel sufficiently close as to define an entry opening therebetween for receiving said workpiece when said mandrel is in an operating position, the width of said opening being no greater than the sum of said thickness of said forming belt plus said thickness of said sheet metal blank when said mandrel is in said operating position, and actuator means moving said mandrel and said first bearing means relative to said frame and relative to said forming roll and said second bearing means in a direction toward said operating position to simultaneously tighten said belt and squeeze said belt against said forming roll.

2. A tube forming machine as set forth in claim 1, including a guide roll having a cylindrical outer surface, said mandrel being disposed between said forming roll and said guide roll, said belt extending around said guide roll.

3. A tube forming machine as set forth in claim 2, including a drive roll, said belt extending around said drive roll, said mandrel and each of said rolls having a longitudinal axis, said axis of said drive roll being disposed on one side of a straight line extending between said axis of said forming roll and said axis of said guide roll, said axis of said mandrel being disposed on the other side of said straight line, said path when viewed from said drive roll being concave around said forming roll and said guide roll and convex around said mandrel, said interior surface of said forming belt engaging said drive roll and said forming roll and said guide roll, and said exterior surface of said forming belt engaging said mandrel.

4. A tube forming machine for shaping a sheet metal blank having a predetermined thickness into a cylindrical tube comprising an elongated mandrel having a cylindrical outer surface, a forming roll having a cylindrical outer surface adjacent said cylindrical outer surface of said mandrel, a guide roll having a cylindrical outer surface, a continuous forming belt extending along an S-shaped path first around said cylindrical outer surface of said forming roll and then between said forming roll and said mandrel and then around said cylindrical outer surface of said mandrel and then between said mandrel and said guide roll and then around said cylindrical outer surface of said guide roll, said forming belt having a predetermined thickness, said forming roll and said mandrel cooperatively defining an entry opening for receiving said sheet metal blank, the width of said entry opening being no greater than the sum of said thickness of said forming belt plus said thickness of said sheet metal blank, said guide roll and said mandrel cooperatively defining an exit opening for said sheet metal blank, and the width of said exit opening being substantially greater than said sum of said thickness of said forming belt plus said thickness of said sheet metal blank.

5. A tube forming machine as set forth in claim 1, wherein the diameter of said cylindrical outer surface of said forming roll is significantly greater than the diameter of said cylindrical outer surface of said mandrel.

6. A tube forming machine as set forth in claim 5, including a drive roll, said belt extending around said drive roll, said mandrel and each of said rolls having a longitudinal axis, said axis of said drive roll being disposed on one side of a straight line extending between said axis of said forming roll and said axis of said guide roll, said axis of said mandrel being disposed on the other side of said straight line, said path when viewed from said drive roll being concave around said forming roll and said guide roll and convex around said mandrel, said interior surface of said forming belt engaging said drive roll and said forming roll and said guide roll, and said exterior surface of said forming belt engaging said mandrel.

7. A tube forming machine as set forth in claim 4, including actuator means for moving said mandrel in a direction to simultaneously tighten said belt and squeeze said belt against said forming roll.

8. A tube forming machine for shaping a sheet metal blank having a predetermined thickness into a cylindrical tube comprising a frame, an elongated mandrel having a cylindrical outer surface, a forming roll having a cylindrical outer surface adjacent said cylindrical outer surface of said mandrel, a guide roll having a cylindrical outer surface, a continuous forming belt extending along a path first around a predetermined circumferential extent of said forming roll and then between said cylindrical outer surface of said forming roll and said mandrel and then around a predetermined circumferential extent of said mandrel and then between said mandrel and said guide roll and then around a predetermined circumferential extent of said guide roll, means holding said forming roll and said mandrel sufficiently close as to define an entry opening therebetween for receiving said sheet metal blank when said mandrel is in an operating position, the width of said entry opening being no greater than the sum of said thickness of said forming belt plus said thickness of said sheet metal blank, means holding said guide roll and said mandrel sufficiently close as to define an exit opening therebetween for said sheet metal blank, the width of said exit opening being substantially greater than said sum of said thickness of said forming belt plus said thickness of said sheet metal blank, and actuator means for moving said mandrel relative to said frame and relative to said forming roll and said guide roll in a direction toward said operating position to simultaneously tighten said belt and squeeze said belt against said forming roll.

9. A tube forming machine as set forth in claim 8, wherein said forming roll and said mandrel each having a longitudinal axis, and said entry opening being disposed in a plane defined by said axes.

10. A tube forming machine for shaping a sheet metal blank having a predetermined thickness into a cylindrical tube comprising a frame, a forming roll and a guide roll each having a cylindrical outer surface, bearing means rotatably mounting said forming roll and said guide roll in spaced apart positions on said frame, a continuous forming belt extending around and engaging said outer surfaces of said forming roll and said guide roll for predetermined angular extents, power means for moving said forming belt, a mandrel having a first end and a second end and a cylindrical outer surface, a first mandrel bearing at said first end and a second mandrel bearing at said second end, first mounting means mounting said first mandrel bearing for movement along a first path relative to said frame between an operating position and an open position, second mounting means mounting said second mandrel bearing for movement along a path relative to said frame and relative to said mandrel between an operating position and an open position, and said forming belt extending around said outer surface of said mandrel for another predetermined angular extent when said mandrel is in said operating position.

11. A tube forming machine as set forth in claim 10, wherein said other angular extent is no greater than 120° and is no less than 90°.

12. A tube forming machine as set forth in claim 10, wherein said first mandrel bearing engages said first end of said mandrel when said first mandrel bearing is in said open position, and said second mandrel bearing is spaced away from said second end of said mandrel when said second mandrel bearing is in said open position.

13. A tube forming machine as set forth in claim 12, wherein said first and second mounting means each include an actuator moving its associated mandrel bearing a predetermined distance between said operating position and said open position, and said predetermined distance of said second mandrel bearing being greater than said predetermined distance of said first mandrel bearing.

14. A tube forming machine as set forth in claim 10, including a frame, and actuator means moving said mandrel and said first and second mandrel bearings relative to said frame and relative to said forming roll in a direction toward said operating position to simultaneously tighten said belt and squeeze said belt against said forming roll.

* * * * *